US007396014B2

(12) United States Patent
Jenkins

(10) Patent No.: US 7,396,014 B2
(45) Date of Patent: Jul. 8, 2008

(54) COUPLES INTERACTIVE RELATIONSHIP QUESTION AND ANSWER BOARD GAME

(76) Inventor: Barbara Elaine Jenkins, 4240 Hutchinson River Pkwy., Apt. 24F, Bronx, NY (US) 10475

( * ) Notice: Subject to any disclaimer, the term of this patent is extended or adjusted under 35 U.S.C. 154(b) by 195 days.

(21) Appl. No.: 11/481,104

(22) Filed: Jul. 5, 2006

(65) Prior Publication Data

US 2007/0007729 A1 Jan. 11, 2007

Related U.S. Application Data

(60) Provisional application No. 60/697,934, filed on Jul. 8, 2005.

(51) Int. Cl.
*A63F 3/00* (2006.01)

(52) U.S. Cl. ..... 273/242; 273/289; 273/429

(58) Field of Classification Search ..... 273/242, 273/287, 289, 290, 429–432
See application file for complete search history.

(56) References Cited

U.S. PATENT DOCUMENTS 1,635,734 A * 7/1927 Ziegler ..... 273/249
5,738,354 A * 4/1998 Easley ..... 273/249
5,826,877 A * 10/1998 Glassman ..... 273/249
6,065,749 A * 5/2000 Debie ..... 273/243
6,267,375 B1 * 7/2001 Bernstein et al. ..... 273/242
6,672,590 B1 * 1/2004 Olsen et al. ..... 273/254
7,073,792 B2 * 7/2006 Esposito ..... 273/243

OTHER PUBLICATIONS

Newlywed Board Game, http://www.boardgamegeek.com/game/9091http://www.boardgamegeek.com/game/9091. 1967.*

* cited by examiner

*Primary Examiner*—William M Pierce
(74) *Attorney, Agent, or Firm*—Donald W. Meeker

(57) ABSTRACT

Paired playing pieces move on steps along a path of a playing area through sections representing stages in a couple relationship in response to matching couple answers on writing surfaces in response to questions on cards from a beginning step through the stages to a winning step. Two individual pieces of each paired playing piece may be separated with one of the individual pieces placed in the dog house area for a mismatch to a question card bearing a dog house insignia. Timed tasks on get out of the dog house cards when performed successfully enable a player's piece to be removed from the dog house and reconnected with the other couple members playing piece to form the paired playing piece.

18 Claims, 3 Drawing Sheets

COUPLES INTERACTIVE RELATIONSHIP QUESTION AND ANSWER BOARD GAME

CROSS-REFERENCE TO RELATED APPLICATIONS

This application claims the benefit of U.S. Provisional Patent Application No. 60/697,934 filed on Jul. 8, 2005.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to board games and personal relationships and in particular to a board game played by couples competing against other couples answering often humorous relationship questions requiring answers which are in agreement for each couple in order to advance through three different relationship stages on the board by moving coupled heart-shaped combinable and separable two-piece player pieces for each couple in order to win the game, including questions which can send one member of a couple to the dog house as well as timed couple activities.

2. Description of Related Art Including Information Disclosed Under 37 CFR 1.97 and 1.98

Friends and families often enjoy playing games together which are most often competitive and not usually intended to bring about increased awareness and appreciation of others in the game. While many forms of therapeutic interaction have been developed, they normally occur in professional offices and may or may not provide elements of fun or enjoyment of the sessions. Prior art games have failed to provide a symbolic transition through the various stages of a couple relationship moving a coupled player piece with real-life questions which must be answered in agreement between the two people to advance along the board and eventually win the game against other couples.

What is needed is an informal fun board game playable by couples competing with each other in a humorous manner with humorous questions and interactive activities to enable the two members of a couple to learn more about each other and test what they already know while also getting to know more about the other couples playing the game.

BRIEF SUMMARY OF THE INVENTION

An object of the present invention is to provide a board game where couples each with a separable two piece player piece representing the couple move through three major stages of a couple relationship from the beginning "once upon a time" through the "honeymoon stage" to the "reality stage" to the "golden stage" and on to "happily ever after" to win the game by agreeing on the most answers to often humorous interpersonal couple questions about each other read from randomly ordered stacks of cards with periodic side trips by one member of the couple to split the heart-shaped couple player piece apart while the member of the couple is in the "dog house" based on a lack of agreement to a question on a card bearing a dog paw symbol.

Another object of the present invention is to provide interpersonal couple interactions according to instructions from another randomly ordered stack of cards, often within a time limit in order to let the other person out of the dog house and rejoin the two halves of the couple player piece to advance across the board One more object of the present invention is to provide an erasable dry marker board or some other writing means for both members of the relationship to record their answers in writing without being able to view the other's answer.

In brief, a board game played by couples competing against other couples answering often humorous relationship questions from a stack of cards for each stage of the relationship depicted on the board requiring written answers on a reusable dry erase marker board or other writing means which are in agreement for each couple in order to advance through three different relationship stages on the board (honeymoon stage, reality stage, and golden stage) by moving coupled heart-shaped combinable and separable two-piece player pieces for each couple over all the spaces in the board from the beginning "once upon a time" space to the end "happily ever after" space in order to win the game.

Each category of cards has male questions marked with a male symbol and female questions marked with a female symbol. Cards which are marked with a dog paw can send one member of the couple to the dog house if there is not an agreement in the answers to the question on the dog paw marked card. The other member of the couple remains in place on the same space until the other member of the couple is out of the dog house and the player piece is united so that it may be advanced on the board. "Get out of the dog house cards" describe couple activities to be performed within a three minute time period set by a timer or requiring a certain number of responses.

An advantage of the present invention is that it provides a fun way for a couple to learn about each other and about other peoples' relationships.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
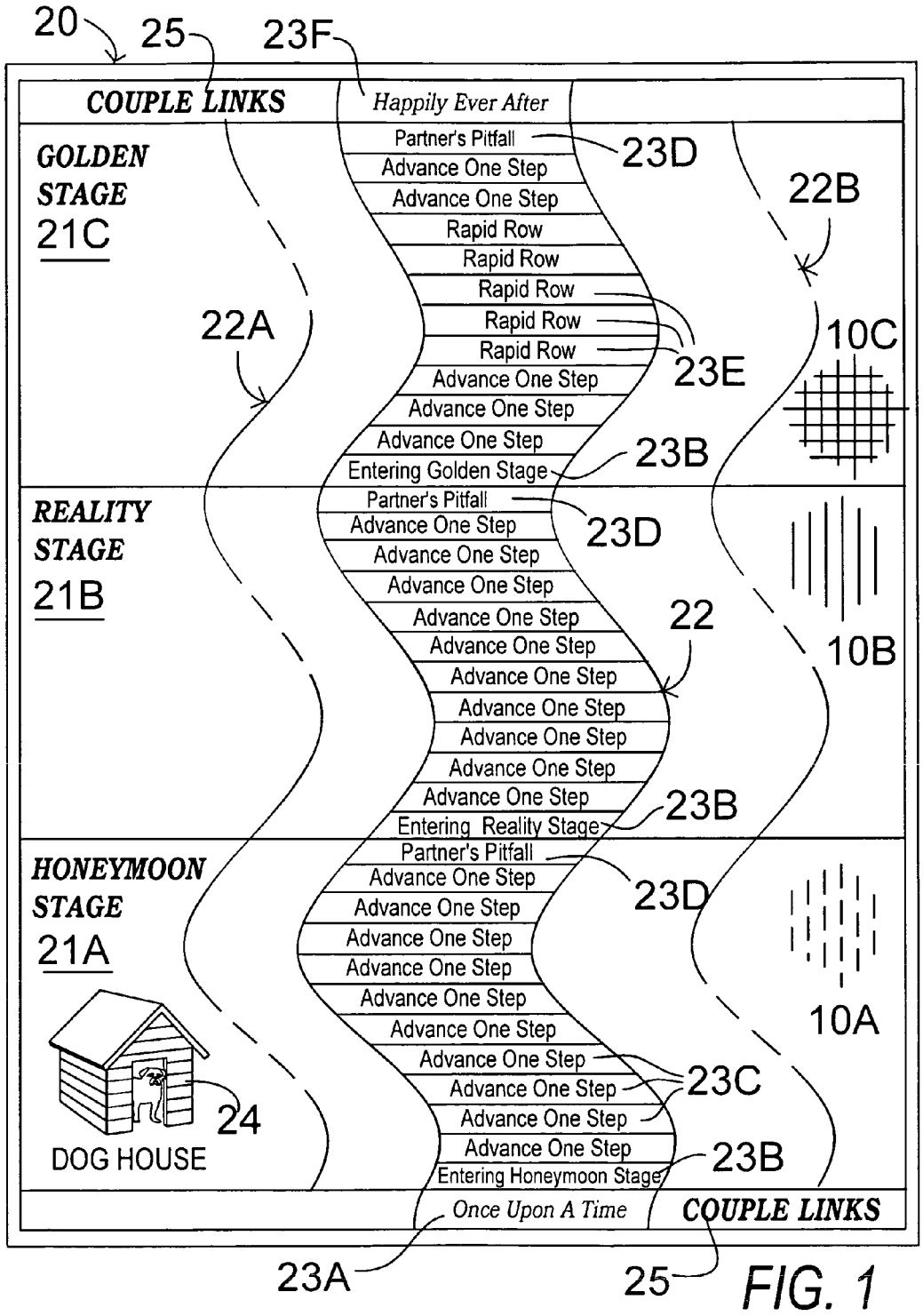
FIG. 1 is a plan view of the playing board of the present invention.
Figure 2:
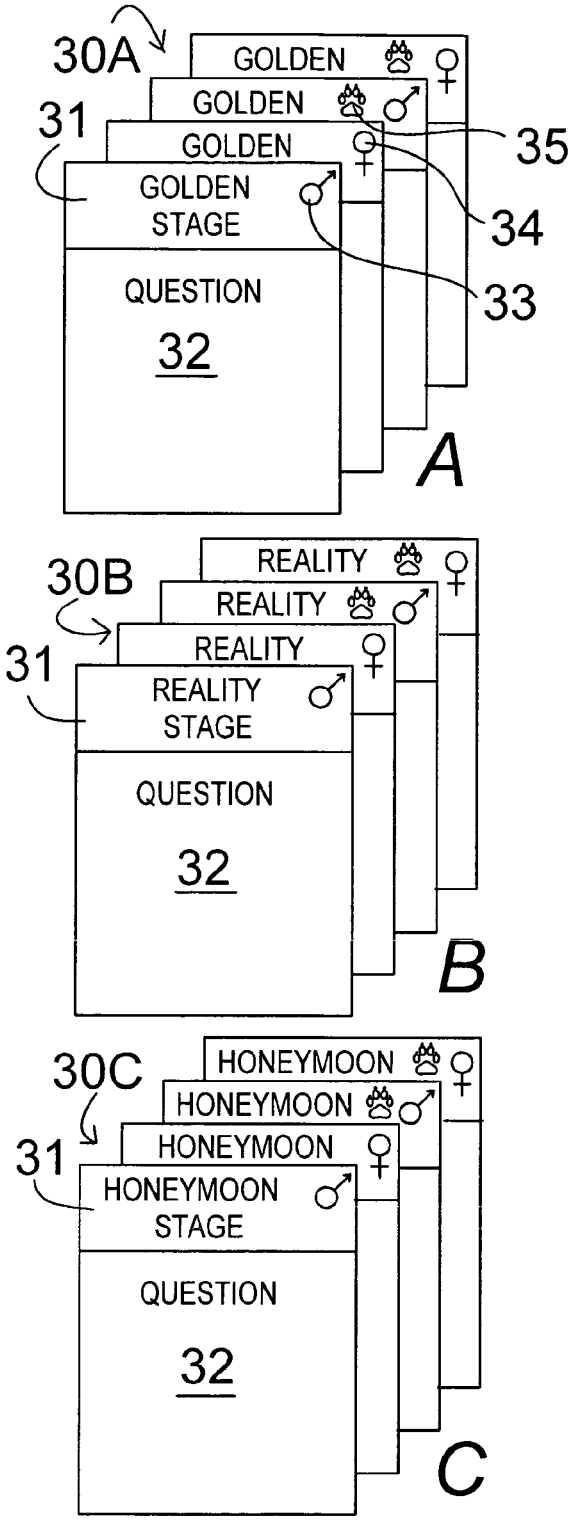
FIG. 2A is a plan view of the four different types of question cards used by a couple whose player piece is positioned in the Golden Stage of play on the playing board of FIG. 1.
FIG. 2B is a plan view of the four different types of question cards used by a couple whose player piece is positioned in the Reality Stage of play on the playing board of FIG. 1.
FIG. 2C is a plan view of the four different types of question cards used by a couple whose player piece is positioned in the Honeymoon Stage of play on the playing board of FIG. 1.

In FIGS. 1-4, a couples interactive relationship game is played by couples against other couples on a playing area 20 with paired playing pieces 40A and 40B moved on steps 23 along a path 22 through sections representing stages 21A, 21B, and 21C in a relationship in response to matching couple answers on writing surfaces 50 written by a couple in response to questions on cards 30A-30D selected on a couples turn, each couple attempting to be the first to go from a beginning step 23A through the stages to a winning step 23F.

The playing area 20 comprising a series of sections representing a series of ordered stages, preferably a Honeymoon Stage 21A, a Reality Stage 21B, and a Golden Stage 21 C of a relationship between two members of a couple. Each of the series of sections bears a different visual appearance from the other sections, preferably labeled with the name of the stage and bearing a different color 10A, 10B, and 10C or pattern or other visual effect.

At least one path 22, 22A, and 22B is formed by a series of steps 23A-23F traversing the series of sections representing moving through the stages of a relationship involving two members of a couple from a beginning step such as Once Upon a Time 23A, representing a beginning of a relationship involving two members of a couple, through the series of sections representing at least an early stage such as the Honeymoon Stage 21A, a middle stage such as the Reality Stage 21B, and a late stage such as the Golden Stage 21C, and ending in a final winning step such as Happily Ever After 23F. The additional paths 22A and 22B shown dashed would be similar to the path 22 illustrated in solid lines and could be sufficient in number for each of the couples paired playing piece to travel a separate path from the other couples paired playing pieces.

A dog house area 24 preferably represented by an image of a dog in a dog house and a label Dog House is spaced apart from the at least one path on the playing area.

Figure 5:
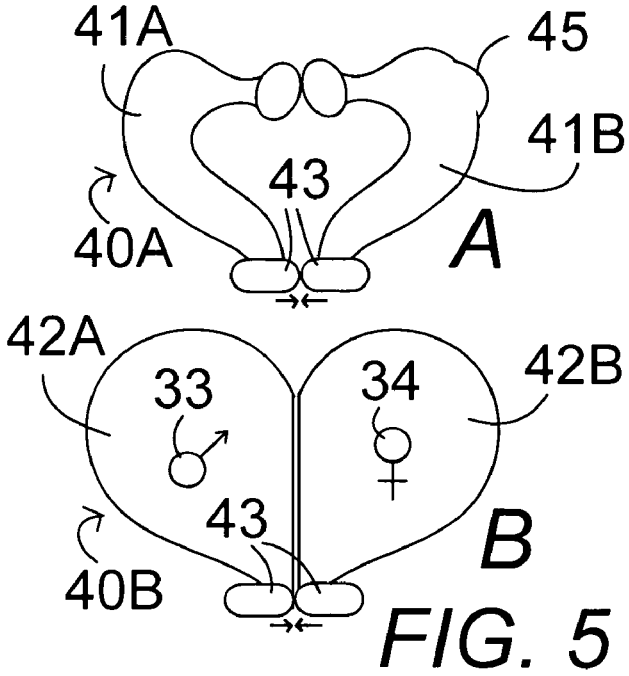
FIG. 5A is a front elevational view of a couple's player piece having two separable shaped three dimensional halves removably interconnected by magnets.
FIG. 5B is a front elevational view of a couple's player piece having two separable shaped planar halves removably interconnected by magnets.

A series of paired playing pieces 40A and 40B, shown in FIGS. 5A and 5B, move through the series of sections by advancing along the series of steps on the playing board from the beginning step 23A through the series of sections 21A, 21B, and 21C to the final winning step 23F. Each of the series of paired playing pieces has two separable individual playing pieces 41A and 41B in FIGS. 5A and 42A and 42B in FIG. 5B, one for each of two members of a couple. Each one of the individual playing pieces represents one of the two members of the couple, and each one of the individual playing pieces is normally attached to the other of the individual playing pieces to form the paired playing piece 40A and 40B representing the couple for normal movement together as one piece along the series of steps of the path and each of the individual playing pieces being separable from the other of the playing pieces of the paired playing piece positioned on a step of the series of steps so that one of the individual playing pieces, such as 41A or 42A is removable to place in the dog house area 24 while the other individual playing piece of the paired playing piece, such as 41B or 42B, remains on the step.

In FIG. 5A, the paired playing piece 40A is formed of two individual three dimensional playing pieces with the left individual piece 41A bearing a visual appearance of a male, such as a smooth abstract human figure, and the right individual playing piece 41B bearing a visual appearance of a female, such as an abstract human figure showing an abstract representation of breasts 45.

In FIG. 5B, the paired playing piece 40B is formed of two individual two dimensional playing pieces with the left individual piece 42A bearing a visual appearance of a male, such as a card bearing a male symbol 33, and the right individual playing piece 42B bearing a visual appearance of a female, such as a card bearing a female symbol 34.

The two individual pieces 41A and 41B in FIGS. 5A and 42A and 42B are held together by bases 43 comprised of magnetically attractive elements held together by a magnetic force indicated by the arrows to enable the paired playing piece to move as a single piece through the steps and to be easily separated when one of the two individual playing pieces is removed to the dog house area 24. In both FIG. 5A and FIG. 5B the connected individual playing pieces together form a simulated heart shape.

The individual playing pieces of the paired playing piece for the playing board version of the game may be fabricated from any of a variety of materials including molded plastic, imprinted cardboard, cast metal, glass, or other materials.

In FIGS. 2A-2C, there is shown a series of question cards 30A, 30B, and 30C for each of the sections from which a member of a couple selects a card when it is a couples turn to select a card, the couples taking alternating turns selecting a card from a section in which a couple's paired player piece is positioned on a step of one of the series of steps in the section. Each of the question cards bears in a top area 31 of the card an indication of a section within which the series of question cards are placed such as the Honeymoon Stage, the Reality Stage, and the Golden Stage, a symbol such as a male symbol 33 and a female symbol 34 representing one of the two members of a couple, and in a bottom portion 32 of the card a question for one member of the couple to ask the other member of a couple. A number of the series of question cards in each of the series of sections also bear an additional symbol such as a dog paw 35 representing the dog house area, to which the asking members individual playing piece will be sent of there is not a match in the answers given by the couple to the question.

Typical questions for each section might include:

Honeymoon Stage Female question: "What is your partner's favorite flavored ice cream?"

Honeymoon Stage Male question: "What is your partner's birth date?"

Reality Stage Female question: "You and your partner have just given birth to a baby boy. The doctor asked do you want your son circumcised. What decision does your partner make?"

Reality Stage Male question: "Who is your partner's favorite sports celebrity?"

Golden Stage Female question: "Your partner was diagnosed with a terminal illness. She is in a coma. Would your partner want you to pull the plug?"

Golden Stage Male question: "How does your partner like to spend Sunday afternoons?"

Figure 4:
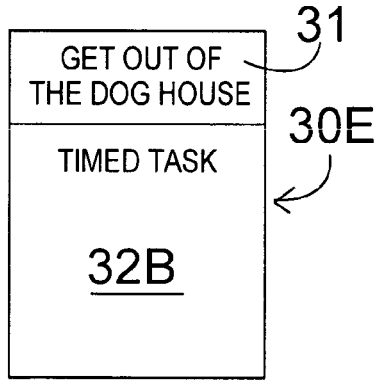
FIG. 4 is a plan view of the type of get out of the doghouse task card used by a member of a couple whose half of the couple's player piece is in the doghouse on the playing board of FIG. 1.

To get out of the dog house area, upon a players next turn the player in the dog house selects a card from a series of task cards such as the Get Out of the Dog House cards 30E of FIG. 4, bearing a task to be performed by a member of a couple having an individual playing piece is in the dog house area so that if the task is performed satisfactorily the individual playing piece is removed from the dog house area and reconnected to the other individual playing piece of the other member of the couple to reform the paired playing piece on the step in the section where the paired couple piece was positioned prior to a removal of the individual playing piece. Get Out of the Dog House tasks include tasks such as the following:

List ten things that you appreciate about your partner before the sand timer runs out.

Recite a rhyming poem about your partner's lips before the sand timer runs out.

Give your partner a hand massage until the sand timer runs out.

Figure 6:
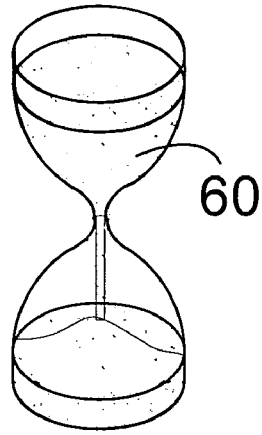
FIG. 6 is a perspective view of an hourglass type timer used for timed tasks in the play of the game of the present invention.

If the task requires a time limit, a timer, such as a sand timer 60 of FIG. 6, is provided and used with the timed task.

Figure 3:
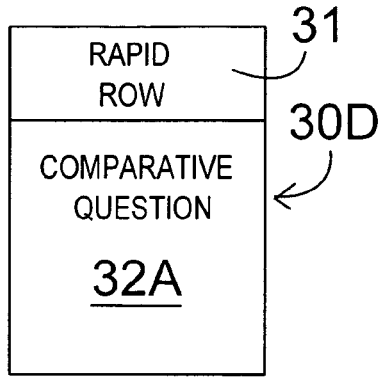
FIG. 3 is a plan view of the type of comparative question card used by a couple whose player piece is positioned on one of the Rapid Row steps of the Golden Stage of play on the playing board of FIG. 1.

In FIG. 1, normally the steps are "Advance One Step" 23C types of steps or an "Entering a Stage" 23B type of step which enable a couple's paired playing piece to move ahead one step if the couple produces matching answers for each couple's turn and the next couple then takes a turn. In addition, a number of adjacent steps in the series of steps of any section, preferably the Golden Stage, may comprise a "Rapid Row" of steps 23E with corresponding rapid row cards 30D, as seen in FIG. 3, each bearing a comparative question asking which member of the couple has a comparatively greater or lesser degree of an attribute so that a match of responses to the comparative question enables a couple to move their paired playing piece to a next step in the rapid row of steps and immediately select another rapid row card so that the couple maintains their turn through the entire "Rapid Row" steps as long as their answers match to each of the comparative questions asked from the "Rapid Row" cards. A typical "Rapid Row" comparative question might be: "Who has a better sense of direction?".

In FIG. 1, when a couple's paired playing piece is on the last step in each of the stages, the step titled "Partner's Pitfall" 23D, the couple must have matched answers from a randomly selected question card to advance one step into the next stage or onto the winning step 23E if the couple's paired playing piece is on the "Partner's Pitfall" step in the final stage. If there is not an agreed answer on this "Partner's Pitfall" step, the paired playing piece must slide back to the beginning step of the stage that they're currently positioned in. If the randomly selected question card displays a dog paw, the command of the "Partner Pitfall" step takes precedence over the "dog house" command and is therefore overruled.

Figure 7:
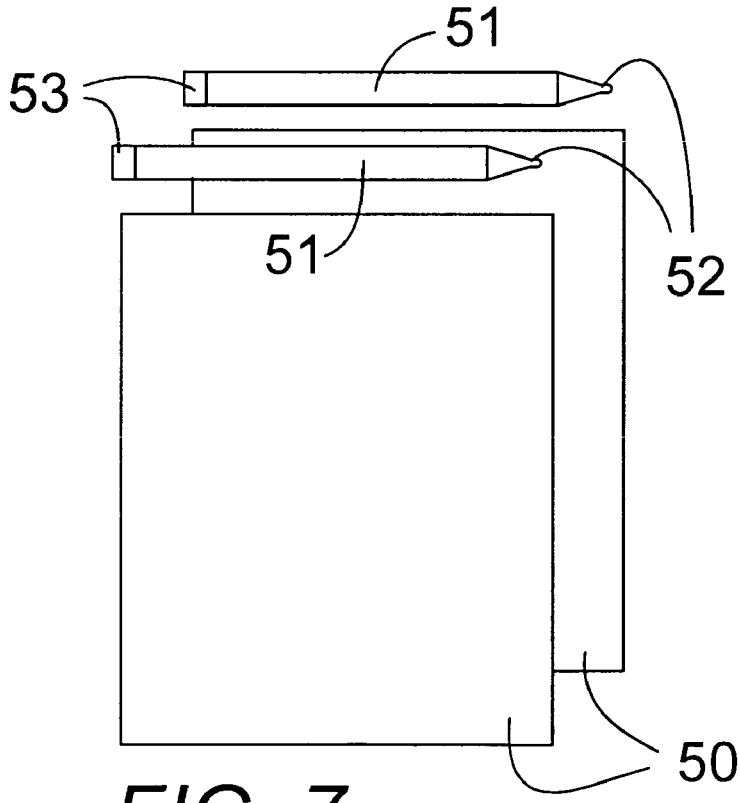
FIG. 7 is a pair of small dry erase write-on tablets and dry-erase markers each with a felt eraser end for use by a couple for each to write an answer to a question on the cards in an effort to match answers to advance along the steps of the playing board of FIG. 1.

In a board version of the game, a board 20, which may fold up, has a top flat surface bearing indicia, which may be printed, representing the series of sections 21A-21C, the at least one path 22, 22A and 22B and the series of steps 23A-23F, and the dog house area 24. In FIG. 7, the writing surfaces comprise dry erase writing surfaces 50 and the means for writing comprise dry erase writing markers 51 with felt tips 52 on one end and dry erase erasers 53 on the other end. The name of the game, Couple Links™ 25 in this case, may be imprinted in the borders or other locations on the board.

In FIG. 7, for the board version of the game, a pair of writing surfaces 50 and writing implements 51 comprise a first writing surface and a first means for writing on the writing surface for the member of the couple being asked a question from a question card to write down the answer to the question on the question card and a second writing surface and a second means for writing on the writing surface for the member of the couple asking the question to write down what the asking member expects the answering member to write for an answer. If both members of the couple using the question card write down the same matching answer their paired playing piece is advanced to a next step along the series of steps and if the both members using the question card do not write down matching answers their paired player piece remains in place on a step in the section. When the question card bears a symbol such as the paw 35 representing the dog house area and both members using the question card do not write down the same answer, the individual playing piece of the player asking the question is separated from the couple's paired playing piece and moved to the dog house area 24.

In a software format of the interactive relationship couple game, play of the game is controlled by a central processing unit so that all of the elements of the game are represented in virtual images on a screen and the movement of the pieces and selection of the cards and the means for writing comprises at least one input device into the central processing unit, as well as the timer function.

The couple having the first couple playing piece to arrive at the final step, such as Happily Ever After 23F, wins the game.

It is understood that the preceding description is given merely by way of illustration and not in limitation of the invention and that various modifications may be made thereto without departing from the spirit of the invention as claimed.

What is claimed is:

1. A couples interactive relationship game played by couples against other couples, the game comprising:

a playing area comprising a series of sections representing a series of ordered stages of a relationship between two members of a couple, each of the series of sections bearing a different visual appearance from the other sections, at least one path formed by a series of steps traversing the series of sections representing moving through the stages of a relationship between two members of a couple from a beginning step representing a beginning of a relationship between two members of a couple, through the series of sections representing at least an early stage, a middle stage and a late stage, and ending in a final winning step, and a dog house area spaced apart from the at least one path;

a series of paired playing pieces for moving through the series of sections by advancing along the series of steps on the playing board normally one step at a time from the beginning step through the series of sections to the final winning step, each of the series of paired playing pieces having two separable individual playing pieces one for each of two members of a couple, each one of the individual playing pieces representing one of the two members of the couple, each one of the individual playing pieces normally attached to the other of the individual playing pieces to form the paired playing piece representing the couple for normal movement together as a paired playing piece along the series of steps of the at least one path one step at a time on each couple's turn to play and each of the individual playing pieces being separable from the other of the playing pieces of the paired playing piece positioned on a step of the series of steps so that one of the individual playing pieces is removable to place in the dog house area while the other individual playing piece of the paired playing piece remains on the step;

a series of question cards for each of the sections for a member of a couple to select a card when it is a couples turn to select a card, the couples taking alternating turns selecting a card from a section in which a couple's paired player piece is positioned on a step of one of the series of steps in the section, each of the question cards bearing an indication of a section within which the series of question cards are placed, a symbol representing one of the two members of a couple, and a question for one member of the couple to ask the other member of a couple, a number of the-series of question cards in each of the series of sections bearing an additional symbol representing the dog house area;

a first writing surface and a first means for writing on the writing surface for the member of the couple being asked a question from a question card to write down the answer to the question on the question card and a second writing surface and a second means for writing on the writing surface for the member of the couple asking the question to write down what the asking member expects the answering member to write for an answer so that if the both members using the question card write down the same matching answer their paired playing piece is advanced to a next step along the series of steps for each couple's turn and if the both members using the question card do not write down matching answers their paired player piece remains in place on a step in the section, and when the question card bears a symbol representing the dog house area and both members using the question card do not write down the same answer, the individual playing piece of the player asking the question is separated from the couple's paired playing piece and moved to the dog house area;

a series of task cards bearing a task to be performed by a member of a couple having an individual playing piece is in the dog house area so that if the task is performed satisfactorily the individual playing piece is removed from the dog house area and reconnected to the other individual playing piece of the other member of the couple to reform the paired playing piece on the step in the section where the paired couple piece was positioned prior to a removal of the individual playing piece;

wherein the first couple playing piece to arrive at the final step wins the game.

2. The couples interactive relationship game of claim 1 wherein a number of adjacent steps in the series of steps comprises a rapid row of steps with corresponding rapid row cards each bearing a comparative question asking which member of the couple has a comparatively greater or lesser degree of an attribute so that a match of responses to the comparative question enables a couple to move their paired playing piece to a next step in the rapid row of steps and immediately select another rapid row card so that the couple maintains their turn through the entire rapid row of steps as long as their answers match to each of the comparative questions asked from the rapid row cards.

3. The couples interactive relationship game of claim 1 wherein a last step in each of the sections comprises a partner's pitfall step so that with a couple's paired playing piece on a partner's pitfall step if the both members of the couple using a question card do not write down matching answers their paired playing piece must move back to a beginning step of the section in which the paired playing piece is currently positioned.

4. The couples interactive relationship game of claim 1 wherein a number of tasks on the task cards are timed tasks require completion in a specified time and further comprising a timer for timing the timed tasks.

5. The couples interactive relationship game of claim 1 wherein the early stage comprises a honeymoon stage, the middle stage comprises a reality stage, and the late stage comprises a golden stage.

6. The couples interactive relationship game of claim 1 wherein the beginning step comprises a once upon a time step.

7. The couples interactive relationship game of claim 1 wherein the winning step comprises a happily ever after step.

8. The couples interactive relationship game of claim 1 wherein one of the individual playing pieces of the paired playing piece comprises a visual appearance of a male and the other of the individual playing pieces of the paired playing piece comprises a visual appearance of a female.

9. The couples interactive relationship game of claim 1 wherein the connected individual playing pieces together form a paired playing piece with a simulated heart shape.

10. The couples interactive relationship game of claim 1 wherein the individual playing pieces of the paired playing piece are fabricated from a material taken from a list of materials comprising plastic, cardboard, metal, and glass.

11. The couples interactive relationship game of claim 1 wherein the individual playing pieces of the paired playing piece are held together by a pair of magnetically attractive elements.

12. The couples interactive relationship game of claim 1 wherein the symbol representing one of the two members of a couple on the question cards comprises a male symbol and the symbol representing the other of the two members of a couple on the question cards comprises a female symbol.

13. The couples interactive relationship game of claim 1 wherein each of the series of sections of the playing area bears a different color.

14. The couples interactive relationship game of claim 1 wherein each of the series of sections of the playing area bears a name of the section.

15. The couples interactive relationship game of claim 1 wherein the playing area is a board with a top flat surface bearing indicia representing the series of sections, the at least one path and the series of steps, and the dog house area.

16. The couples interactive relationship game of claim 1 wherein the writing surfaces comprise dry erase writing surfaces and the means for writing comprise dry erase writing markers.

17. The couples interactive relationship game of claim 1 wherein the at least one path comprises a plurality of paths each with a series of steps traversing the series of stages from a beginning step to a winning step.

18. The couples interactive relationship game of claim 1 wherein the game is programmed in a software format and play of the game is controlled by a central processing unit so that all of the elements of the game are represented in virtual images on a screen and the movement of the pieces and selection of the cards and the means for writing comprises at least one input device into the central processing unit.

* * * * *